343-700 MS AU 251 EX
11/18/86 OR 4,623,894

United States Patent [19]
Lee et al.

[11] Patent Number: 4,623,894
[45] Date of Patent: Nov. 18, 1986

[54] INTERLEAVED WAVEGUIDE AND DIPOLE DUAL BAND ARRAY ANTENNA

[75] Inventors: Kuan M. Lee, Brea; Ruey S. Chu, Cerritos; Nam S. Wong, Fullerton; James U. Clark, Anaheim; Raymond Tang, Fullerton, all of Calif.

[73] Assignee: Hughes Aircraft Company, Los Angeles, Calif.

[21] Appl. No.: 623,857

[22] Filed: Jun. 22, 1984

[51] Int. Cl.[4] ..... H01Q 21/28
[52] U.S. Cl. ..... 343/700 MS; 343/727; 343/776
[58] Field of Search ..... 343/725, 727, 729, 730, 343/700 MS, 776

[56] References Cited

U.S. PATENT DOCUMENTS

| | | | |
|---|---|---|---|
| 3,623,111 | 11/1971 | Provencher et al. | 343/727 |
| 3,818,490 | 6/1974 | Leahy | 343/727 |
| 3,825,932 | 7/1974 | Hockham | 343/776 |
| 3,882,505 | 5/1975 | Mailloux | 343/739 |
| 3,921,177 | 11/1975 | Munson | 343/846 |
| 4,097,868 | 6/1978 | Borowick | 343/727 |
| 4,298,878 | 11/1981 | Dupressoir et al. | 343/795 |
| 4,319,249 | 3/1982 | Evans et al. | 343/703 |
| 4,445,122 | 4/1984 | Pues | 343/700 |

OTHER PUBLICATIONS

R. J. Mailloux, Analysis of a Dual-Frequency Array Technique, IEEE Transactions on Antennas and Propagation, vol. AP-27, No. 2, Mar. 1979, pp. 130-136.

J. K. Hsiao, Analysis of Interleaved Arrays of Waveguide Elements, IEEE Transactions on Antennas and Propagation, vol. AP-19, No. 6, Nov., 1971, pp. 730-735.

C. Chen, Broad-Band Impedance Matching of Rectangular Waveguide Phased Arrays, IEEE Transactions on Antennas and Propagation, vol. AP-21, No. 3, May, 1973, pp. 298-302.

*Primary Examiner*—Eli Lieberman
*Attorney, Agent, or Firm*—Howard R. Lambert; Anthony W. Karambelas

[57] ABSTRACT

A dual band array antenna is disclosed having interleaved waveguide and dipole arrays, each operating in a different frequency band. The orientation of the waveguides and dipoles is such that polarization of the signals of the two frequency bands is perpendicular to each other, thus reducing mutual coupling. The waveguides are used for the higher frequency band and their cutoff frequency is selected to be above the lower frequency band at which the dipoles operate, in order to reduce mutual coupling into the waveguides. In one embodiment the dipoles are printed on a substrate having a dielectric constant selected so that dipole spacing is the same as the waveguide spacing. This eliminates grating lobe formation in the radiation pattern of the waveguide array. A low pass filter is included in the dipole feed circuit to reject the frequencies at which the waveguides operate. As a result of the invention, two beams of two different frequency bands are independently and simultaneously steerable in a single antenna aperture.

19 Claims, 8 Drawing Figures

Fig. 3.
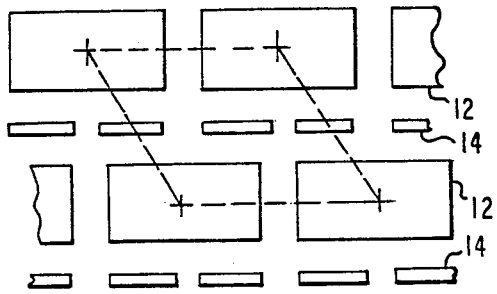
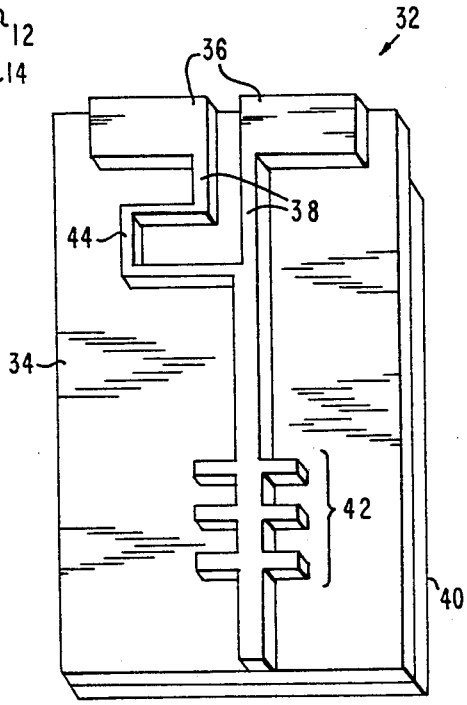
Fig. 4.
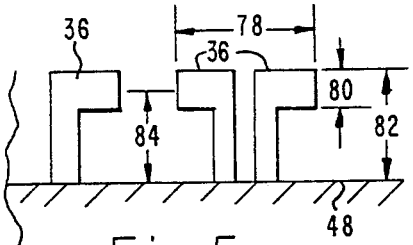
Fig. 5.
Fig. 8.
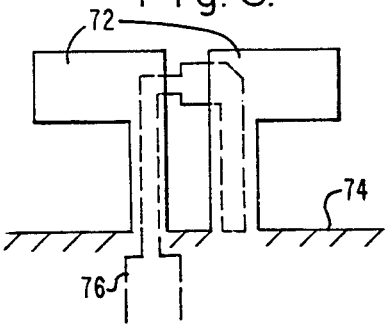

INTERLEAVED WAVEGUIDE AND DIPOLE DUAL BAND ARRAY ANTENNA

The Government has rights to this invention pursuant to Contract No. F-19628-81-C-0082 awarded by the Department of the Air Force.

BACKGROUND OF THE INVENTION

The invention relates generally to antennas and, more particularly, to dual band array antennas.

In applications where multiple antennas are needed but space is very limited, an antenna system having two antennas operating at different frequencies while sharing a common antenna aperture would be desirable. Where each antenna sharing the common aperture possesses a separate feed system and beam steering control, then multiple independent tasks can be performed by the single antenna aperture. The beams for each antenna can be steered independently and simultaneously.

Problems existing in prior art techniques for sharing an antenna aperture between two antennas include the generation of grating lobes, poor impedance matching in the lower frequency elements due to the presence of the higher frequency elements in the common aperture, and the mutual coupling of power into the other antenna elements. Applications requiring a wide scan angle with low side lobe levels and with no grating lobe formation have also posed design problems and have not been satisfactorily overcome.

SUMMARY OF THE INVENTION

It is an object of the invention to provide a dual band array antenna which overcomes most, if not all, of the above-described problems existing in prior art techniques by providing a dual band array antenna having an array of waveguides interleaved with an array of dipoles, the beams of which are independently and simultaneously steerable.

It is also an object of the invention to provide a dual band array antenna wherein each antenna has good impedance matching for its frequency while having a capability of wide angle scanning; and to provide an antenna having reduced mutual coupling between the two antennas sharing the common aperture.

It is also an object of the invention to provide a dual band array antenna wherein grating lobes are not formed in real space by either antenna sharing the common aperture.

It is also an object of the invention to provide a dual band array antenna which is relatively easy and inexpensive to manufacture and which is reliable and durable.

It is also an object of the invention to provide a dual band array antenna which is compact in size and light in weight.

The invention attains the above objects and other objects by providing a dual frequency band array antenna capable of scanning two independent beams at different frequencies having interleaved waveguide and dipole radiators. Open-ended rectangular waveguides are used for the higher frequency band and are spaced from each other by an amount dependent upon the scan angle desired such that grating lobes are not generated. Interleaved with the open-ended waveguides are dipole radiators for operating at the second and lower frequency band. The waveguides and dipoles are oriented in relation to each other such that their respective signals are perpendicularly polarized.

In a preferred embodiment, the dipoles and their feed circuits are printed in the form of microstrip on a high dielectric constant substrate. These microstrip circuits are interleaved with the waveguides so that the spacing of the dipoles in relation to each other is the same as that of the waveguides. This spacing permits scanning over a wide angle in the lower frequency band also without generating grating lobes.

In one embodiment the waveguide and dipole elements are interleaved such that a row of waveguides is followed by a row of dipoles and the distances between rows are equal. The waveguides are oriented in the rows such that adjacent waveguides have a common narrow wall. The dipoles are oriented in relation to the waveguides such that the dipole wings are parallel to waveguide broad walls. In both the rows of waveguides and dipoles, the spacing of the individual elements from one another is the same. Also the positioning of elements is such that columns of aligned alternating waveguides and dipoles are formed.

This dense array environment completely eliminates grating lobe formation for both frequency bands. There are two array antennas sharing a common antenna aperture. The dipole conductors or "wings" are oriented parallel to the broad walls of the open-ended waveguides, therefore, the polarization of the signals of the waveguide array is perpendicular to the polarization of the signals of the dipole array and mutual coupling is reduced.

The waveguide size is selected such that at the lower frequency band in which the dipoles operate, the waveguide is below its cutoff frequency and there will be no coupling of the dipole energy into the waveguide circuit. In the dipole circuit, a filter is included for blocking the passage of signals of the higher frequency band in which the waveguides operate. In a preferred embodiment, a low pass filter is printed in the form of microstrip on the same substrate as the dipole wings and the dipole feed circuit.

BRIEF DESCRIPTION OF THE DRAWINGS

For a more complete understanding of the invention as well as further purposes and advantages thereof, reference is now made to the accompanying drawings, wherein:

FIG. 3 is a schematic front view of an array antenna in accordance with the invention where there is shown a parallelogram lattice structure of interleaved waveguide and dipole radiators;

FIG. 4 is a perspective view of a dipole usable in the invention showing the microstrip structure, also shown is a filter and a balun connected to the dipole which are a part of the microstrip structure;

FIG. 5 is a schematic view showing the protrusion of the dipole wings above the effective ground plane;

FIG. 8 is a schematic view of a dipole element usable in the embodiment of FIG. 7.

DETAILED DESCRIPTION OF THE INVENTION

Figure 1:
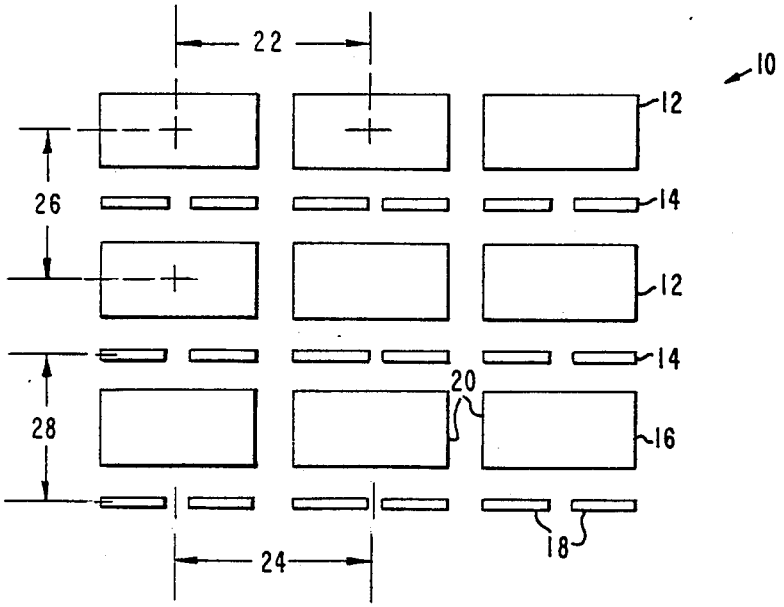
FIG. 1 is a schematic front view of an array antenna in accordance with the invention, where there is shown a rectangular lattice structure of interleaved waveguide and dipole radiators.

In the following description, like reference numerals are used to refer to like elements in the different figures. Referring with more particularity to FIG. 1, there is shown an array antenna 10 in accordance with the invention. Open-ended waveguide radiators 12 are interleaved with dipole radiators 14. Although an array 10 of three-by-three elements (total of 9 waveguide radiators and 9 dipole radiators) is shown, this is for illustration purposes only and is not intended to be restrictive of the invention. A greater or lesser number of elements may be used as desired. Furthermore, although the numerals 12 and 14 only specifically point to two elements each, it is intended that numeral 12 indicate all the waveguide radiators shown in FIG. 1 and numeral 14 indicate all the dipole radiators shown in FIG. 1. Also, the description "planar array" used herein is used for convenience of description only and is not meant to be restrictive. It should be understood that planar array is to include cases where the array is distorted such as to take on a curved shape or to otherwise conform to a non-flat surface as required by the application. However in those cases, there would still be a single layer, integral structure of waveguide radiators and dipole radiators such as that shown in FIG. 1.

As shown in FIG. 1, there are rows of waveguide radiators 12 interleaved with rows of dipole radiators 14. The waveguide radiators 12 are oriented so that all waveguide broad walls 16 are parallel and the dipole radiators 14 are oriented so that all dipole conductors or "wings" 18 are parallel and are also parallel to the waveguide broad walls 16. In the waveguide rows, the waveguides are oriented such that the narrow walls 20 of adjacent waveguides face each other. In the embodiment shown in FIG. 1, the waveguides 12 and dipoles 14 are arranged in a rectangular lattice structure. That is, if lines were drawn between the centers of four adjacent waveguides, a rectangle would be formed. The same is true for lines drawn between the centers of four adjacent dipoles.

Also, there is the same spacing between adjacent waveguide elements 12 as there is between adjacent dipole elements 14. Distance 22 between the centers of adjacent waveguides 12 as measured along the broad wall direction is equal to the distance 24 between the centers of adjacent dipoles 14 as measured along the dipole wing direction. Also, the distance 26 between the centers of sequential rows of waveguides 12, i.e., as measured along the narrow wall direction, is equal to the distance 28 between the centers of sequential rows of dipoles 14 as measured along the dipole wing height direction.

Also shown in FIG. 1 is an embodiment where there is a particular alignment of waveguide and dipole elements. As described above, the spacing of waveguides in their rows is the same as the spacing of dipoles in their rows. In addition to having rows of equally spaced elements interleaved, the positions of the elements in the rows are such that they are aligned with the corresponding element above and below them. Thus there are columns of alternating waveguide and dipole elements. In FIG. 1, two arrays having the same spacing between constituent elements have been combined into a single aperture. Thus there is a corresponding element in each array for each element in the other array.

Figure 2:
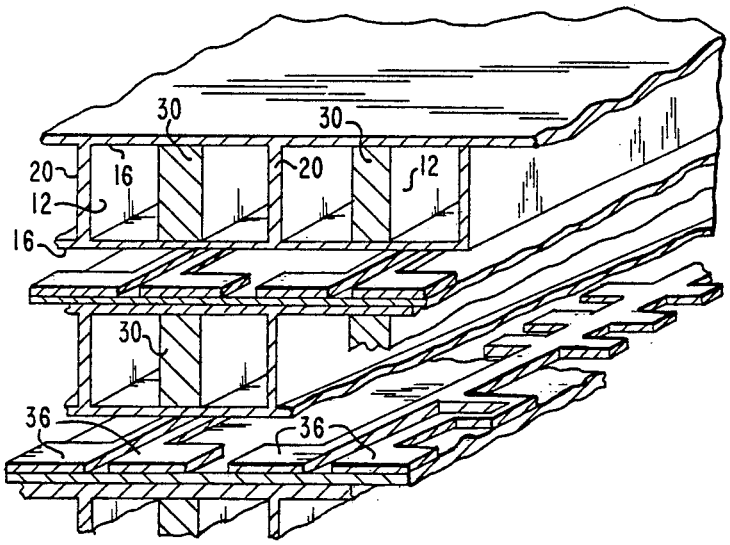
FIG. 2 is a partially cutaway perspective view of a part of FIG. 1, showing interleaved waveguide and dipole radiators with dielectric loading of the waveguide radiators and the microstrip structure of a dipole radiator.

A partially cut away perspective view of part of FIG. 1 is given in FIG. 2. The waveguides 12 are rectangular in shape, having two parallel broad walls 16 separated by two parallel narrow walls 20. In the rows of waveguides, compactness is obtained by forming them such that adjacent waveguides have common narrow walls 20.

Although not intending to be bound by theory, it is believed that particular advantages of the invention are due to the following theoretical discussions. In order to scan at a selected angle and still avoid the formation of grating lobes, a particular spacing of the array elements is required. Where a maximum scan angle is desired, extreme compactness of radiating elements is required. Using a common narrow wall 20 between adjacent waveguides 12 results in compactness of the waveguide array size. Further compactness can be obtained by reducing the size of the waveguide and loading these reduced size waveguides with a dielectric slab 30 to permit positioning them closer together while still operating in the desired frequency band. Partial loading is shown in FIG. 2 where the waveguides 12 are loaded with dielectric slabs 30.

For the rectangular lattice structure shown in FIGS. 1 and 2, it has been found that the following formula yields the element spacing required to avoid the generation of grating lobes.

$$\frac{s}{\lambda} < \frac{1}{1 + |\sin \theta_0|}$$

In the above formula:

s = spacing between elements, $\lambda$ = wavelength, $\theta_0$ = the scanning angle.

In accordance with the above, grating lobes will not occur in real space where the spacing is less than $\lambda/2$ in free space. Where the scanning angle is limited to less than $\pm 90°$, the spacing may be increased accordingly.

The above description and formula are directed towards the antenna aperture having a rectangular lattice structure such as that shown in FIGS. 1 and 2. Other lattice structures are possible depending upon requirements such as scanning coverage and physical packaging. Another usable arrangement of radiating elements is the parallelogram lattice structure shown in FIG. 3. In this lattice structure, the spacing between the individual elements and the spacing between the rows is the same as for that of the rectangular lattice shown in FIGS. 1 and 2. However, alternating rows of elements are shifted in position such that lines drawn between the centers of four adjacent elements forms a parallelogram as is shown in FIG. 3. A discussion of spacing and grating lobe formation in regard to different structures is found in M. I. Skolnik, *Radar Handbook*, 1970, pgs. 11-15 to 11-21.

As discussed above, where the application of the antenna is such that a large scanning angle is required, the waveguide element spacing may be very close to avoid grating lobe formation. In some applications this may require using a waveguide having a size so small that the cutoff frequency of the waveguide is above the frequency band of operation. It has been found that in such a case, the cutoff frequency of the waveguide may be lowered by loading the waveguide with a dielectric. One method of implementing this is shown in FIG. 2 where the waveguides 12 are partially loaded with dielectric slabs 30. FIG. 2 also shows the method of obtaining waveguide compactness by sharing common narrow walls 20 with adjacent waveguides 12 in the row.

In the invention, the waveguides are used to operate in the higher frequency band and the dipoles are used to operate in the lower frequency band. In order to reduce coupling of signals of the lower frequency band into the waveguide circuit, the size of the waveguides is selected so that the lower frequency band is below the cutoff frequency of the waveguides.

To conduct the lower frequency band of the dual band antenna, dipole radiators are used. FIG. 4 shows an embodiment of a dipole radiator 32 usable in the invention. A microstrip dipole 32 printed on a dielectric substrate 34 is shown. The dipole has two conductors or "wings" 36, which, when interleaved between the waveguides 12 in accordance with the invention, will be parallel with the broad walls of the waveguides as shown in FIGS. 1, 2 and 3. Because of this particular orientation, the polarization of the signals of the dipoles will be perpendicular to the polarization of the signals of the waveguides. That is, the E-field radiated from the waveguide openings is perpendicular to the E-field radiated from the dipoles. This perpendicular polarization aides in reducing mutual coupling between the waveguide and dipole elements of the array.

In one embodiment, as described above and shown in FIG. 1, the spacing between the dipoles 14 is the same as the spacing between the waveguides 12. Since the dipoles 14 operate in the lower frequency band, they have been printed on a relatively high dielectric constant substrate in this embodiment in order to reduce their size. The dielectric constant of the substrate is chosen to result in the desired dipole radiator spacing and where that spacing is less than one-half of a free space wavelength, grating lobes will not be formed in real space.

Referring further to FIG. 4, the dipole radiator 32 comprises the dipole wings 36 printed on a substrate 34 and having two feed lines 38 which feed respective dipole wings 36. One technique for constructing the dipole shown in FIG. 4 is to form the wings 36 and feed lines 38 of copper which is printed on the substrate 34. On the opposite side of the substrate 34, a ground plane 40 is printed. As is shown, the ground plane extends under the feed lines 38 but does not extend under the dipole wings 36. Suitable substrates are alumina or the Epsilam material manufactured by the 3-M Company, 6023 South Garfield, Los Angeles, Calif., 90040.

As described above, to avoid coupling signals in the lower frequency band into the waveguide circuit, the waveguide cutoff frequency was selected to be above the frequency of the lower frequency band at which the dipoles operate. In the case of the dipoles however, a low pass filter is added in the dipole circuit to block signals in the higher frequency band at which the waveguides operate. Although the dipole polarization is perpendicular to the waveguide polarization, it has been found that the dipole feeds can conduct components of the radiated waveguide signals. A method for constructing a low pass filter which is usable in the invention is shown in FIG. 4 where the low pass filter 42 is printed as microstrip on the same substrate 34 as the dipole wings 36 and dipole feeds 38. This low pass filter 42 is designed to be transparent to the frequency band in which the dipoles operate but to reject the frequency band in which the waveguides operate. The ground plane 40 extends under the low pass filter 42 on the opposite side of the substrate 34. The exact dimensions of the low pass filter vary in accordance with the operation frequencies. Design of such filters is known to those skilled in the art. For a reference which gives greater detail, refer to Matthaei, Young and Jones, *Microwave Filters, Impedance Matching Networks and Coupling Structures,* Artech House Books, 1980, pgs. 608, 609.

In addition to the low pass filter 42 a balun 44 is also connected in the dipole circuit 32. As shown in FIG. 4, the balun 44 connects the low pass filter 42 with the dipole feeds 38. The balun 44 introduces a 180° phase difference in the pair of dipole feeds 38 and converts the single feed line to the balanced dual feed lines required by the dipole wings 36, and vice versa. Design of baluns is known in the art. For a reference giving greater detail, refer to Johnson, Jasik, *Antenna Engineering Handbook,* 2d ed., McGraw-Hill, pgs. 43-23 to 43-27.

The effective ground plane for the dipole 14 array is the waveguide 12 array which acts similarly to a wire mesh ground plane (refer to FIGS. 1 and 2). The waveguide openings at the ground plane of the dipole array act like an imperfect ground plane such that a reactive loading effect is produced on the active radiation impedance of the dipole array 14. It has been found that the openings of the waveguides shift the dipole impedance somewhat. In order to achieve better matching of the dipoles, it has been found that the dipole wings 36 should be extended out in front of the waveguide 12 openings as shown in FIG. 2. This is shown in a top view in FIG. 5 where the amount of extension is shown as the distance 82 and is selected to obtain matching between the dipole wings 36 and the ground plane 48. In FIG. 5, a ground plane 48 is shown; however, it has been found that this ground plane does not necessarily coincide with the waveguide 12 openings. In most cases, the effective ground plane is located at a certain distance behind the waveguide 12 openings. Thus, the amount of extension 46 shown in FIG. 5 should not necessarily be considered to be the distance between the dipoles and the waveguide openings.

Regarding the effect of the protruding dipoles 14 on the waveguides 12, it has been found that the effect of the protruding dielectric boards containing the dipole wings 36 on the radiation impedance of the open-ended waveguide array is equivalent to having a layer of dielectric radome covering the ground plane.

A further advantage of the invention is that a plurality of dipole circuits each having the wings 36, the feeds 38, the balun 44, the low pass filter 42 and any matching and transforming devices required may be printed on a common substrate which results in uniformity of the dipole array and ease in manufacture and assembly. Alternatively, single dipole cards, such as that shown in FIG. 4, may be manufactured and located in relation to the waveguides in accordance with the invention.

The dipole circuit 32 with a balun 44, feed lines 38 and low pass filter 42 as shown in FIG. 4 may be connected to a coaxial feed (not shown) at the low pass filter 42. Appropriate means for matching the microstrip low pass filter 42 and balun 44 in relation to each other and to the coaxial feed may be required. Such means are known to one skilled in the art. For greater detail, refer to Matthaei, Young and Jones above.

Figure 6:
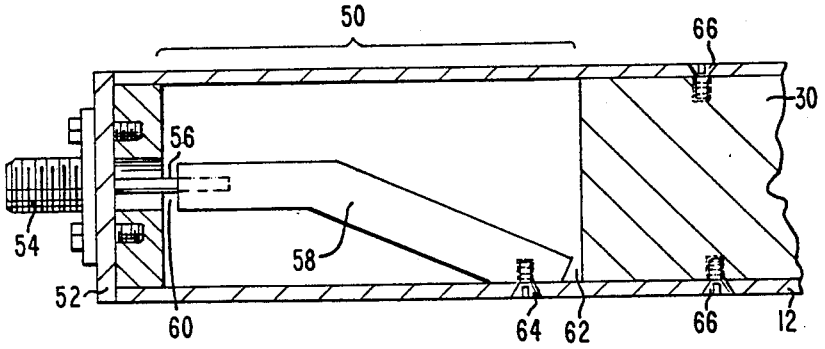
FIG. 6 is a side sectional view of a waveguide coaxial cable transition usable in the invention.

In FIG. 6, there is shown a coaxial/waveguide transition 50 usable in the waveguide array of the invention. Where the waveguides are to be fed by coaxial lines, greater compactness can be achieved by using an end-on transition such as that shown in FIG. 6. In this figure, the waveguide 12 has a dielectric slab 30 disposed within it, such as that shown in FIG. 2, for partial loading purposes as discussed above. The waveguide 12 has an end plate 52 to which the coaxial connector 54 is attached. The center conductor 56 of the coaxial connector 54 extends into the waveguide 12 and contacts the waveguide transition probe 58. A gap 60 between the waveguide end plate 52 and the waveguide transition probe 58 is used for tuning the transition 50. Similarly, a gap 62 between the waveguide transition probe 58 and the dielectric loading slab 30 is used for tuning. Screw mount 64 is shown for firmly mounting the waveguide transition probe 58 adjacent the dielectric slab 30 within the waveguide 12. Screw mounts 66 are shown for firmly mounting the dielectric slab 30 within the waveguide 12.

Figure 7:
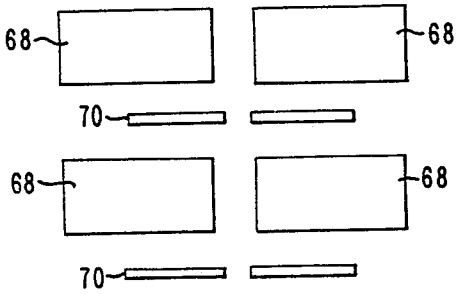
FIG. 7 is a schematic front view of an array antenna in accordance with the invention showing interleaved waveguides and dipoles.

A second embodiment is shown in FIG. 7 where there are four open-ended waveguides 68 interleaved with two dipoles 70. As in FIGS. 1, 2 and 3, the dipoles 70 and waveguides 68 are oriented such that the dipole wings are parallel to the broad waveguide walls. Thus, the polarizations of the respective signals are perpendicular to each other. Also, as in FIG. 1, the number of waveguides and dipoles shown is not meant to be restrictive. A larger number of elements may be used as desired.

The combination of four waveguides 68 with two dipoles 70 as shown in FIG. 7, however, functions as a unit cell in one embodiment. Since the dipoles 70 are spaced further apart than the waveguides 68, the danger of grating lobe formation in the higher frequency band for the H-plane of the waveguide is present.

It has been found that by making one of the two dipoles 70 parasitic, i.e., terminating the feed line with a reactive load, the costs of a phase shifter and feed circuit are saved. One method of termination is placing stubs in the feed line which present an equivalent open circuit for the frequency band of the waveguides. A purpose of including a parasitic element is to present a finer grid spacing for the signals of the waveguide frequency band to eliminate the grating lobe formation and to maintain a minimum disturbance to the impedance of the active dipoles. The parasitic elements in the invention are used in the H-plane of the dipoles and the E-plane of the waveguides.

A dipole usable in this embodiment is shown in FIG. 8. Because the dipoles are not spaced as closely together as in the prior embodiment, the dipole may be printed on a lower dielectric constant substrate. As shown in FIG. 7, the dipole 70 spacing in the rows of elements is approximately twice that of the waveguides. The dielectric constant of the substrate on which the dipole is disposed is selected to result in this desired spacing.

As shown in FIG. 8, there are two dipole wings 72 which are connected to the ground plane 74 which in this case, is printed on the same side of the substrate as the printed wings. As exciter or feed line 76 is shown in dotted lines since it is printed on the opposite side of the substrate as the wings 72. Various sizes of feed line are shown and these are used for transforming and matching purposes. As is known in the art, the sizes of the various feed lines and the dipole wings are a function of the frequency of operation and the dielectric constant of the substrate. The distance between the wings 72 and the ground plane 74 is based on matching. For greater detail, refer to R. Bawer, J. J. Worfe, "Printed Circuit Patterns For Use With Spiral Antennas," IRE PG MTT, 1960, May, pgs. 319–325.

Although some previous descriptions of embodiments of the invention have shown the dipole elements aligned with one or more adjacent waveguide elements, it should be noted that the dipole elements may be shifted in position. Furthermore, certain descriptions contained herein have referred to the antenna's use in a radiating mode. This is not intended to be meant in a restrictive sense, since the antenna is capable of operation in both radiation and reception modes. Reference to radiation is generally used for convenience in describing the operation of the invention.

Although no particular feed method has been shown in the drawings, the invention is capable of block feeding. In one embodiment of block feeding, a single phase shifter may control a single waveguide radiator, while a separate single phase shifter may control a block of four dipole radiators. This technique would be facilitated by etching or printing a plurality of dipole circuits on a single substrate and connecting two dipoles at their feed points to the external phase shifter circuit.

An operating embodiment of the invention was built with the waveguide array operating at C-band and the dipole radiators operating at S-band. The C-band waveguide inner dimensions were 1.160 inches × 0.620 inches with a spacing between centers of 1.285 inches as measured along the broad waveguide wall direction and 0.860 inches along the narrow waveguide wall direction. Each waveguide had a dielectric slab inserted having dimensions of 0.620 inches × 2.230 inches and a thickness of 0.100 inches. The material used was Rexolite, manufactured by Reynolds and Taylor, Inc., 2109 S. Wright Street, Santa Ana, Calif. 92705, and had a dielectric constant of 2.55.

The S-band dipole dimensions (refer to FIG. 5) were a length 78 of 1.060 inches, a width 80 of 0.230 inches, a protruding height 82 of the dipole board above the ground plane 48 of 0.560 inches which was 0.500 inches above the waveguide openings, a distance 84 from the ground plane 48 to the center of the dipole 36 of 0.445 inches which was 0.385 inches above the waveguide openings, a dielectric constant of the substrate 34 (FIG. 4) of 10.2 and a substrate 34 thickness of 0.025 inches. An 8 × 8 element (64 waveguides, 64 dipoles) was manufactured and scanning was measured for the waveguide array in the E-plane and the dipole array in the H-plane for up to 60 degrees scan; and also for the waveguide array in the H-plane and the dipole array in the E-plane for up to 20 degrees scan. Results indicate low side lobe levels for the whole scan range. The isolation levels were better than 50 dB for each array.

Thus, there has been shown and described a new and useful dual band array antenna comprising an array of waveguides interleaved with an array of dipoles. Each constituent array can be independently scanned; There is good impedance matching even in the presence of the other array; mechanical packaging and feeding concepts have been demonstrated as relatively easy; and there is a wide scanning angle with low side lobe levels and the absence of grating lobe formation. Although the invention has been described and shown in detail, it is anticipated that modifications and variations may occur to those skilled in the art which do not depart from the inventive concepts. It is intended that the invention be limited only by the scope of the claims, not by the description, and so the invention will include such modifications and variations unless the claims limit the invention otherwise.

What is claimed is:

1. A dual band array antenna comprising:

a. a plurality of similar, open-ended rectangular waveguides configured for operating in a first frequency band, each said waveguide comprising two opposing broad walls and two opposing narrow walls, and each said waveguide having a cut off frequency below the first frequency band;

the waveguides being arranged in a substantially equally spaced apart relationship in a plurality of rows with the broad walls of each of the waveguides substantially parallel to the broad walls of the other waveguides;

b. a plurality of microstrip dipoles configured for operating in a second frequency band which is substantially lower than the cut off frequency of the waveguides;

the dipoles being formed on a dielectric substrate having a dielectric constant of at least about 5, the dipoles being arranged in a substantially equally spaced apart relationship in a plurality of rows which are interleaved with the rows of waveguides, the dipoles being oriented substantially parallel with one another and in relation to the waveguides such that the polarization of signals from the dipoles is perpendicular to the polarization of the signals from the waveguides, the lateral separation between the dipoles in any row thereof being no greater than about twice the lateral spacing of the waveguides in adjacent rows;

c. first feeding means for feeding signals of the first frequency band to the waveguides;

d. second feeding means for feeding signals of the second frequency band to the dipoles; and e. a plurality of microstrip filters, each of the filters being connected to a corresponding one of the dipoles, the filters being configured for substantially blocking signals of the first frequency band in the second feeding means.

2. The dual band array antenna by claim 1 wherein the dipoles within the rows of dipoles are laterally spaced from each other by substantially the same amount as are the waveguides in an adjacent row of waveguides.

3. The dual band array antenna of claim 2 wherein:

the waveguides are arranged in the rows of waveguides such that they are substantially aligned with waveguides in adjacent rows of waveguides; and the dipoles are arranged in the rows of dipoles such that they are substantially aligned with waveguides in adjacent rows thereby forming a rectangular lattice structure of rows of waveguides and dipoles.

4. The dual band array antenna of claim 3 wherein:

the number of waveguides in the array is equal to the number of dipoles in the array; and the waveguides and dipoles are arranged such that the number of rows of waveguides is equal to the number of rows dipoles and the number of dipoles in each dipole row are equal, the number of waveguides in each waveguide row are equal and the number of dipoles in a dipole row is equal to the number of waveguides in a waveguide row.

5. The dual band array antenna of claim 2 wherein:

the waveguides are arranged in the rows of waveguides such that they are at a preselected angle from waveguides in adjacent rows of waveguides; and the dipoles are arranged in the rows of dipoles such that they are aligned with waveguides in an adjacent row of waveguides but are at substantially the same preselected angle from dipoles in adjacent rows of dipoles as the waveguides are from adjacent rows of waveguides, thereby forming a parallelogram lattice structure of rows of waveguides and dipoles.

6. The dual band array antenna of claim 1 wherein:

the waveguides in the rows have a predetermined spacing from adjacent waveguides in the same row; and the dipoles in the rows have a spacing from adjacent dipoles in the same row of approximately twice that of an adjacent row of waveguides.

7. The dual band array antenna of claim 1 wherein the dipoles in alternating rows of dipoles are parasitic dipoles.

8. The dual band array antenna of claim 1 wherein the filters comprise low pass filters.

9. The dual band array antenna of claim 8 wherein the low pass filters are formed from microstrip on a substrate having a dielectric constraint substantially equal to the dielectric constant of the substrate on which the microstrip dipoles are formed.

10. The dual band array antenna of claim 9 further comprising a plurality of baluns each of said baluns being connected between the second feeding means and an associated one of the low pass filters, the baluns being formed of microstrip and being disposed on the same substrate as the filters.

11. The dual band array antenna of claim 1 wherein the dielectric constant of the substrate on which the microstrip diodes are formed is equal to at least about 9.

12. The dual band array antenna of claim 1 wherein the first frequency band is about twice the second frequency band.

13. The dual band array antenna of claim 1 wherein the first frequency band is the C band and the second frequency band is the S band.

14. The dual band array antenna of claim 1 including dielectric loading means disposed in the waveguides.

15. The dual band array antenna of claim 14 where the dielectric loading means include a slab of dielectric material disposed in each of the waveguides, the dielectric material having a dielectric constant of at least about 2.

16. A dual band array antenna comprising:

a. a plurality of of similar open ended, rectangular waveguides configured for operating in a first frequency band, each said waveguide comprised of two opposing broad walls and two opposing narrow walls, each said waveguide having a cut off frequency below the first frequency band;

the waveguides being arranged in a plurality of rows each having substantially the same number of waveguides, the waveguides being substantially equally spaced apart in all said waveguide rows and being arranged with the broad walls thereof mutually parallel;

b. a plurality of microstrip dipoles configured for operating in the second frequency band which is nominally about half of said first frequency band; the dipoles being arranged in a plurality of rows each having substantially the same number of dipoles, the rows of dipoles being interleaved with the rows of waveguides so as to form an array of alternating rows of waveguides and dipoles, the dipoles being arranged in a mutually parallel relationship, with the dipoles oriented so that the polarization of signals from the dipoles is perpendicular to the polarization of signals from the waveguides, the spacing between adjacent dipoles in any of the dipole rows being no greater than about twice the spacing between adjacent waveguides in any of the waveguide rows, the dipoles being formed as microstrips on a dielectric substrate having a dielectric constant of at least about 9;

c. first and second feeding needs for respectively feeding signals of the first frequency band to the waveguides and signals of the second frequency band to the dipoles; and d. a plurality of microstrip filters, each of the filters being connected to a corresponding dipole and being formed on a dielectric substrate having substantially the same dielectric constant as the dielectric substrate on which the dipoles are formed, the filters being configured for substantially blocking signals of the first frequency band in the second feeding means.

17. The dual band array antenna of claim 16 wherein the spacing of the dipoles in the rows of dipoles is substantially equal to the spacing of the waveguides in the rows of waveguides and wherein the dipoles are aligned with waveguides in adjacent rows of waveguides.

18. The dual band array antenna of claim 16 wherein the first frequency band is the C band and the second frequency is the S band.

19. The dual band array antenna of claim 16 wherein alternating rows of the dipoles comprise rows of parasitic dipoles.

* * * * *